US006647585B1

(12) United States Patent
Robinson

(10) Patent No.: US 6,647,585 B1
(45) Date of Patent: Nov. 18, 2003

(54) MULTI-FUNCTIONAL FLOOR-CLEANING TOOL

(75) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 10/011,144

(22) Filed: Nov. 6, 2001

Related U.S. Application Data

(60) Provisional application No. 60/246,184, filed on Nov. 6, 2000.

(51) Int. Cl.[7] ..... A47L 9/02

(52) U.S. Cl. ..... 15/322; 15/401; 239/754

(58) Field of Search ..... 15/321, 322, 401; 239/754

(56) References Cited

U.S. PATENT DOCUMENTS

| | | | | | |
|---|---|---|---|---|---|
| 2,243,935 | A | | 6/1941 | Williamson | |
| 3,802,628 | A | | 4/1974 | Goss et al. | |
| 3,913,837 | A | | 10/1975 | Grant | |
| 4,218,900 | A | | 8/1980 | Caplan et al. | 15/322 |
| 4,270,238 | A | | 6/1981 | Shallenberg et al. | 15/321 |
| 4,461,052 | A | | 7/1984 | Mostul | |
| 4,596,061 | A | | 6/1986 | Henning | 15/322 |
| 4,654,925 | A | | 4/1987 | Grave | 15/322 |
| 4,879,784 | A | | 11/1989 | Shero | 15/322 |
| 5,212,848 | A | | 5/1993 | Geyer | 15/401 |
| 5,377,382 | A | * | 1/1995 | Bores et al. | 15/320 |
| 5,455,982 | A | * | 10/1995 | Armstrong et al. | 15/320 |
| 5,584,094 | A | | 12/1996 | Gurstein | 15/321 |
| 5,706,548 | A | | 1/1998 | Schabacker | 15/322 |
| 5,813,087 | A | | 9/1998 | Huffman | 15/321 |
| 5,819,366 | A | | 10/1998 | Edin | 15/322 |
| 5,898,970 | A | | 5/1999 | Straiton | 15/321 |
| 5,991,968 | A | | 11/1999 | Moll et al. | 15/322 |
| 6,052,861 | A | | 4/2000 | Keller | 15/321 |
| 6,055,699 | A | | 5/2000 | Cho | 15/321 |
| 6,206,980 | B1 | | 3/2001 | Robinson | 134/21 |
| 6,247,202 | B1 | * | 6/2001 | Lesco et al. | 15/320 |
| 6,453,506 | B1 | * | 9/2002 | Sumner | 15/322 |

* cited by examiner

*Primary Examiner*—Theresa T. Snider
(74) *Attorney, Agent, or Firm*—Wood, Herron & Evans LLP

(57) ABSTRACT

In one aspect of the invention, the tool includes: a housing having a front wall, a back wall, a top wall connecting the front and back walls, an interior surface, a liquid-delivery opening, and a soil-uptake opening, the soil-uptake opening being connectable to a vacuum source; a first squeegee blade depending from the front wall; a second squeegee blade depending from the back wall; an interior space defined by the interior surface, first squeegee blade, and second squeegee blade; a diverter valve connected to the housing, the diverter valve having at least an inlet, a first outlet, a second outlet, and a diverter, the diverter capable of selectively directing the flow of a pressurized liquid from the inlet to either the first outlet or the second outlet, the diverter valve being connectable to a pressurized-liquid source; a high-pressure nozzle connected to the first outlet of the diverter valve, the high-pressure nozzle constructed and arranged to deliver a liquid into the interior space via the liquid-delivery opening; and a low-pressure nozzle connected to the second outlet of the diverter valve, the low-pressure nozzle constructed and arranged to deliver a liquid exterior to the interior space.

11 Claims, 5 Drawing Sheets

MULTI-FUNCTIONAL FLOOR-CLEANING TOOL

CROSS-REFERENCE TO RELATED APPLICATION

This latent document claims the benefit of the filing date of Provisional U.S. patent application Ser. No. 60/246,184 entitled "Multi-Functional Floor-Cleaning Tool" and filed on Nov. 6, 2000. The entire disclosure of that provisional U.S. patent application is incorporated into this patent document by reference.

BACKGROUND OF THE INVENTION

1. Field of the Invention

This invention is directed to a multi-functional floor-cleaning tool capable of directing a high-pressure jet of liquid onto a hard surface, while substantially confining the liquid to the interior space of the tool when the tool is positioned in contact with the particular surface, and when a vacuum is generated, thereby evacuating soils and sprayed liquid from the interior of the tools to a remote location Such tools are appropriate for use in cleaning any suitable surface, with non-limiting examples including tile floors, tile walls, and other hard surfaces.

2. Description of the Related Art

Maintaining the cleanliness of commercial, industrial, institutional, and public buildings is an ongoing effort, and at times, an effort which seems more like a losing battle. This is particularly true for areas such as restrooms, locker rooms, cafeterias, food service kitchens, patient rooms, waiting rooms, factory floors, and other high-traffic areas, where the volume of traffic in the particular area may make it difficult to maintain the cleanliness of the facility.

Building maintenance staff typically clean such areas on a routine basis using traditional mop-and-bucket assemblies, in which the bucket includes a detachable mop wringer, and is positioned on caster wheels, thereby enabling a building maintenance person to move the mop bucket from place to place, typically by pushing on the mop handle. Depending on the cleanliness of the mop, a worker may be able to make a good start in cleaning a floor using the mop bucket system. However, as soon as the worker makes a first pass and wrings the mop out, the entire mop bucket system is contaminated. From that point on, each time the worker plunges the mop into the bucket and rings the mop out, both the mop and "cleaning water" become more and more dirty.

One way to attempt to solve this problem is to make frequent water and mop changes. However, this adds time to an already laborious process, and therefore, there is little worker incentive to make frequent water and mop changes. Moreover, because a slop sink, source of clean water, or custodial supply room may be far away, a worker is even less inclined to make water and mop changes.

The end result is that a dirty floor gets cleaned by pushing dirty water around with a dirty mop. At best, the surface may have the appearance of being cleaned if concentrated spots of highly visible soil have been removed or spread around. In reality, however, given the limitations of these tools, the worker still is simply pushing dirt around the floor, as evidenced by the "five-o'clock shadow" of dirt seen frequently along the surface of walls adjacent the floor, as well as the "finger painting-like streaks" left by the mop when the water on the floor dries.

The cleanliness problem may be especially severe in the restrooms of these various buildings, and in fact, the number-one building maintenance complaint is dirty restrooms. Given the frequency with which these facilities are used, as well as the tools available for cleaning restrooms, the dirty restrooms complaint is not particularly surprising. Building maintenance workers typically use the mop-and-bucket system described above to clean restrooms floors. And, as noted above, while this system may pick up some dirt, it tends more typically to spread dirty water around on the floor. In addition, the mop-and-bucket system simply does not "cut it" when comes to dealing with greasy, slippery kitchen floors. Moreover, as with many restrooms floors, most kitchen floors are formed of tiles having group lines in between each tile. And because the group lines tend to hold onto grease and other soils even more tenaciously than the tiles themselves, it has been extremely difficult, if not impossible, to thoroughly clean such kitchen floors.

The sanitation maintenance industry offers other pieces of cleaning equipment, such as pressure washers, wet vacs, pump-up sprayers, and janitor's carts. However, because of the limitations of several of these tools, as well as their single-task focus, sanitary maintenance professionals tend to use them in actual cleaning either infrequently, or not at all.

Most pressure washers operate at a pressure of 1000 PSI and above, a pressure which is far too high for many cleaning applications. For example, if such a pressure washer were use to mechanically clean a painted wall, it would blast the paint off of the wall surface. On the other end of the pressure spectrum are pressure washers having a pressure of about 100 PSI or less. And because of the type of pump used in these low pressure sprayers, the liquid exiting the sprayer actually has a far, far lower pressure, for example, about 40 PSI. Although such a low-pressure washer may be beneficial in applying a cleaning solution, it lacks the mechanical power required to actually clean a particular surface once the solution has been applied. Because pressure washers generally include a single clean-liquid water tank or container, both cleaning chemicals and water are loaded into this same container, which may be damaging to the device, particularly if a harsh cleaning chemical passes through a mechanical component, such as a pump. Because most pressure washers do not have there own water source, an operator must use a garden-type hose, and must have ongoing access to a corresponding faucet throughout the pressure washing process. Moreover, these pressure washers generally lack a convenient on-board storage system for storing the garden hose and power cord during transport.

Conventional wet-vacs provide a user with the ability to vacuum soiled cleaning solution from a floor. However, movement of these devices from place to place can be difficult because the vac hose, wand, and various tools typically must be carried independently of the wet-vac device. Furthermore, the drain outlet on such devices is designed for draining into a custodial slop sink, thereby requiring the user to take the wet-vac to a particular location in order to drain the device.

Pump-up sprayers also are available, which enable a sanitation maintenance worker to sprinkle a cleaning solution under low-pressure onto a particular surface. In addition, the Industry provides various mobile janitorial carts, which may include storage shelves for various supplies, as well as a frame for a trash bag.

As is apparent from the discussion of the various cleaning tools presented above, sanitary maintenance professionals have a variety of tools from which to choose. However, these tools are either inadequate to do a proper cleaning job, or are so task-specific that they become user-unfriendly, given the many aspects involved in proper sanitation maintenance. Accordingly, given the relative ineffectiveness and/or inefficiency of the various tools available, particular facilities are not cleaned as well or as frequently as they should be, and morale and job satisfaction among many building maintenance professionals are relatively low.

SUMMARY OF THE INVENTION

The invention overcomes the limitations discussed above by providing a multi-functional floor-cleaning tool for use with a pressurized-liquid source and a vacuum source. In one aspect of the invention, the tool includes: a housing having a front wall, a back wall, a top wall connecting the front and back walls, an interior surface, a liquid-delivery opening, and a soil-uptake opening, the soil-uptake opening being connectable to a vacuum source; a first squeegee blade depending from the front wall; a second squeegee blade depending from the back wall; an interior space defined by the interior surface, first squeegee blade, and second squeegee blade; a diverter valve connected to the housing, the diverter valve having at least an inlet, a first outlet, a second outlet, and a diverter, the diverter capable of selectively directing the flow of a pressurized liquid from the inlet to either the first outlet or the second outlet, the diverter valve being connectable to a pressurized-liquid source; a high-pressure nozzle connected to the first outlet of the diverter valve, the high-pressure nozzle constructed and arranged to deliver a liquid into the interior space via the liquid-delivery opening; and a low-pressure nozzle connected to the second outlet of the diverter valve, the low-pressure nozzle constructed and arranged to deliver a liquid exterior to the interior space.

In another aspect, the high-pressure nozzle of the multi-functional floor-cleaning tool has an outlet orifice, and the high-pressure nozzle is constructed to deliver a focused, pinpoint jet of liquid from the outlet orifice.

In a further aspect, the low-pressure nozzle is constructed and arranged to deliver a liquid downward from behind the back wall of the housing.

In yet another aspect, the low-pressure nozzle is a fan nozzle, whereby a liquid exiting the low-pressure nozzle has a fan-shaped pattern.

In yet a further aspect, the low-pressure nozzle has an outlet orifice and an arcuate deflector plate spaced from the outlet orifice.

In another aspect, the diverter valve is a three-way valve having an inlet, a first outlet, a second outlet, and a diverter, the diverter capable of selectively directing the flow of a liquid from the inlet to either the first outlet or the second outlet.

In a further aspect, the diverter valve includes a handle operatively connected to the diverter, thereby enabling an operator to selectively direct the flow of a liquid from the inlet to either the first outlet or the second outlet.

In yet another aspect, the diverter of the diverter valve may be oriented in a plurality of positions so as to provide larger and smaller flow paths to the first outlet, larger and smaller flow paths to the second outlet, and a completely blocked flow path to both the first and second outlets.

In yet a further aspect, each of the first and second squeegee blades has an exterior surface and a base surface, the exterior surface including serrations which extend from the base surface upward toward the housing.

In another aspect, the housing further includes at least two wheels or glides.

The various aspects of the invention discussed briefly above combine to provide an effective and efficient multi-functional floor-cleaning tool, useful in cleaning numerous areas in and around commercial, industrial, institutional, and public buildings. Moreover, because the various aspects of the invention allow a sanitation maintenance worker to clean the floor of a particular room or facility more effectively, and to do so without having to touch soiled surfaces directly with the hands, the invention actually provides an incentive for these workers to do a thorough cleaning job, and may even assist in boosting worker morale. These and other benefits and advantages of the invention will be made apparent from the accompanying drawings and the detailed description of the drawings.

BRIEF DESCRIPTION OF THE DRAWINGS

The accompanying drawings, which are incorporated in, and constitute a part of, this specification, illustrate embodiments of the invention, and, together with the general description of the invention given above and the detailed description of the drawings given below, serve to explain the principles of the invention.

Any suitable sources of pressurized liquid and vacuum may be used in connection with the various versions of the tool of the invention. For example, if desired, a multi-functional cleaning machine such as the one described and shown in Robinson U.S. Pat. No. 6,206,980 may be used. The entire disclosure of the '980 patent is incorporated into this patent application by reference.

Figure 1:
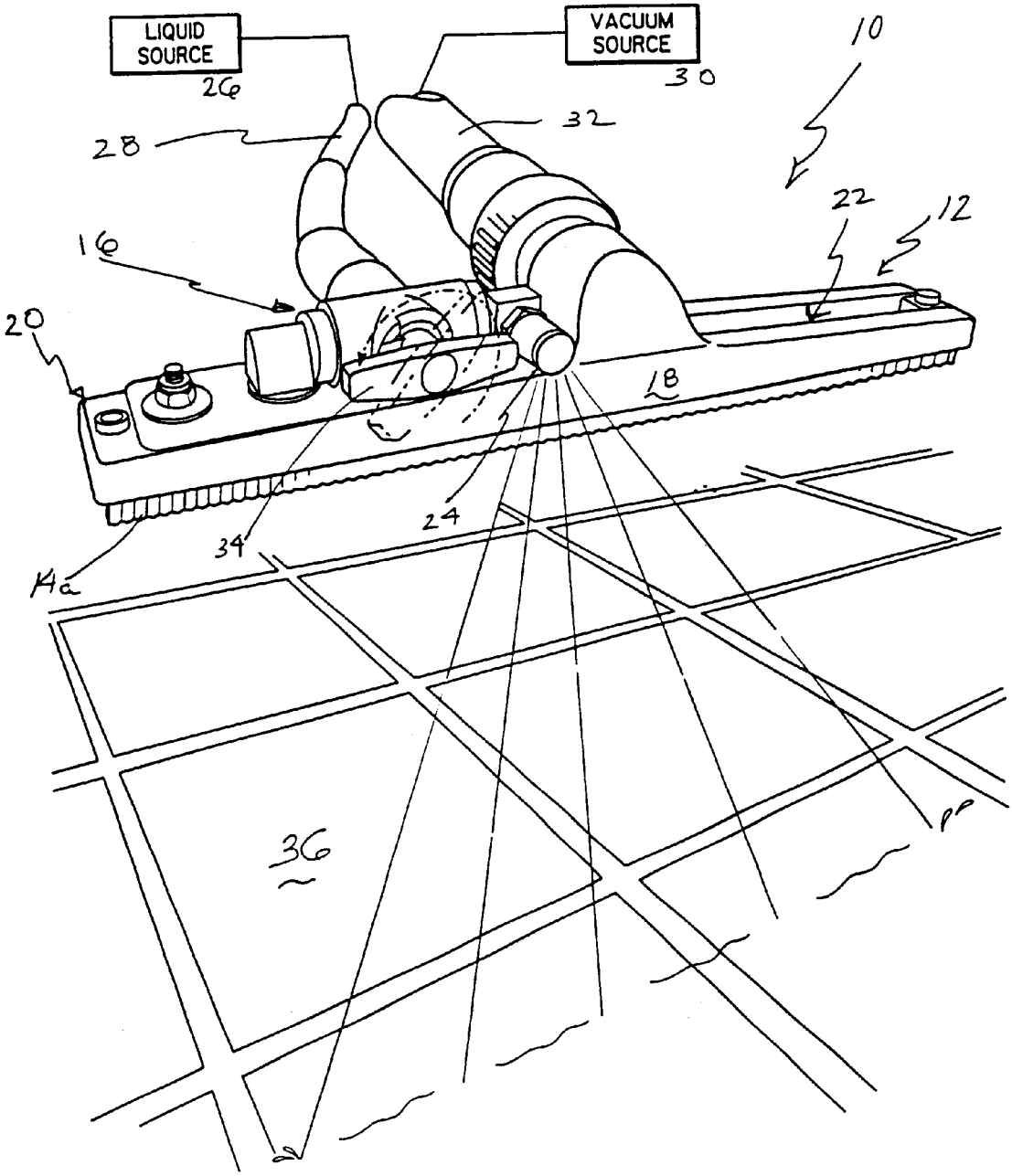
With reference to FIG. 1, one particular multi-functional floor-cleaning tool 10 includes a housing 12, a pair of wheels (not shown) connected to the housing, first and second squeegee blades 14*a* (one shown) depending from the housing, an interior chamber (not shown) defined by the interior surface of the housing and the squeegee blades, and a diverter valve assembly 16 connected to the housing 12. The housing 12 includes a front wall 18 and back wall 20 connected by a top wall 22. The diverter valve assembly 16 enables an operator to select between a high-pressure focused-spray valve (not shown, but described below in connection with FIGS. 2 and 3) and a low-pressure fan-pattern valve 24 which extends forward of the front wall. As shown, the tool 10 is connected to a source of pressurized liquid 26 via a pressure hose 28. The tool also is connected to a vacuum source 30 via a wand 32.

As shown in FIG. 1, the diverter valve assembly 16 includes a handle 34 which has been rotated completely toward the low-pressure nozzle 24. Accordingly, liquid is being sprayed in a fan-shaped pattern, from the nozzle 24 onto a floor 36. This feature is particularly beneficial to an operator because it allows an operator to quickly and easily wet alarge surface area, prior to vacuuming up a soiled solution. Also, if the tool 10 is used in connection with a device such as the multi-functional cleaning machine described and shown in Robinson U.S. Pat. No. 6,206,980 ("the '980 machine"), an operator is able to apply a cleaning solution through the low-pressure nozzle 24.

Because of the design of the low-pressure valve 24, the back-pressure in the pressure hose drops to the point at which cleaning chemical is injected into the pressurized liquid line of the '980 machine, via a Venturi-type chemical injector. And because the pressure is sufficiently low, aerosolization of chemicals is prevented. If the operator wants to wet or rinse the floor without applying a cleaning chemical, they may simply disconnect the chemical draw line from the particular chemical concentrate.

Figure 2:
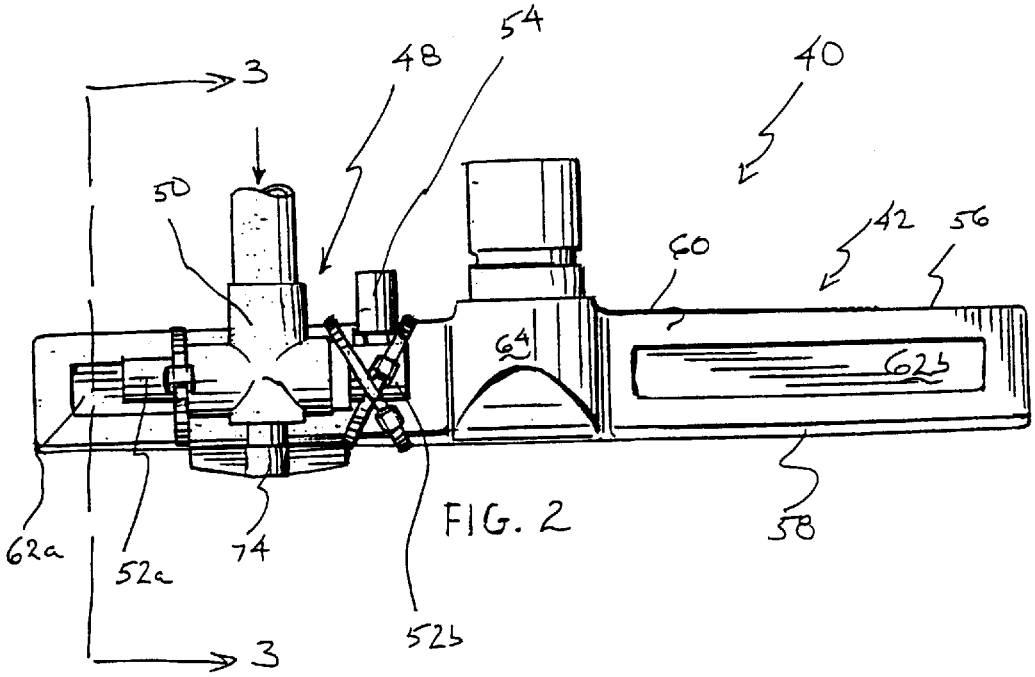
Figure 3:
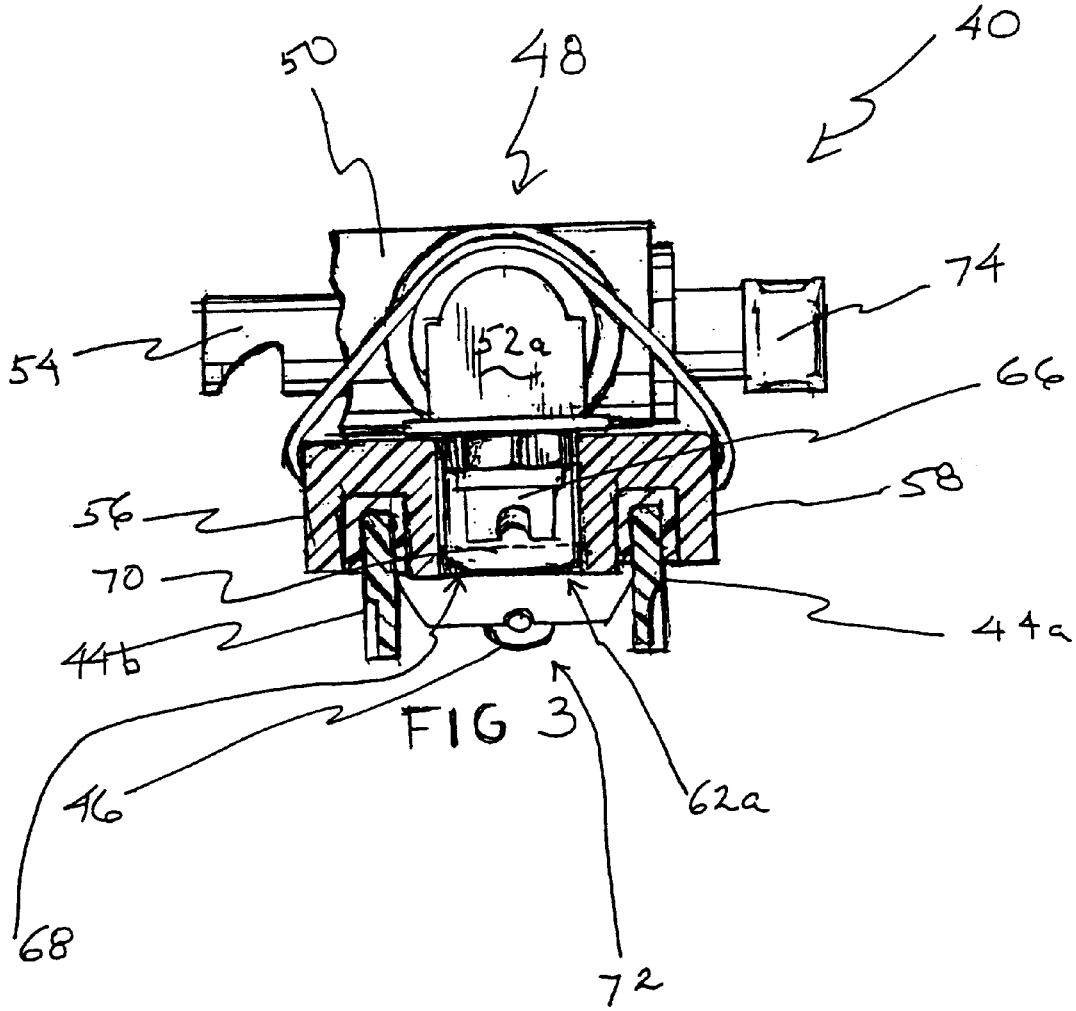

With reference to FIGS. 2 and 3, another multi-functional floor-cleaning tool 40 includes a housing 42, first and second squeegee blades 44*a,b* depending from the housing 42, a pair of wheels 46 (one shown) connected to the housing 40, and a diverter valve assembly 48. The diverter valve assembly 48 is connected to the housing 40 via several tie straps. As with the tool of FIG. 1, the spray nozzles of this tool are connected to the diverter valve 50 via 90 degree elbows 52*a,b*. However, with this particular tool 40, the low-pressure nozzle 54 extends beyond the housing back wall 56, instead of the housing front wall 58.

As best seen in FIG. 2, the top wall 60 of the housing is formed so as to have an elongated recessed channel 62*a,b* on either side of the vac-uptake crown 64. As best seen in FIG. 3, the diverter valve assembly 48 is mounted adjacent the recessed channel 62*a*, with the high-pressure valve 66 situated in this channel 62*a*, positioned just above the liquid-delivery opening 68 formed in the top wall 60 of the housing 42. A short piece of cylindrical tubing 70 encases the lower portion of the high-pressure valve 66, and extends down to the liquid-delivery opening 68, thereby facilitating the flow of liquid into the interior space 72.

In order to operate the tool 40 in the high-pressure focused-spray mode, an operator simply rotates the handle 74 completely toward the 90 degree elbow D leading to the high-presure valve 66. The operator typically will want to have the vacuum source on, when operating in this mode. A high-pressure, focused blast of water will be jetted from the outlet orifice of the valve 66, thereby providing an intense, mechanical, cleaning action capable of removing serious soils from group lines, tile, and other flooring materials. If the tool 40 is used in combination with a machine like the '980 machine, because of the design of the high-pressure valve 66, a back-pressure is maintained in the pressure hose coming from the source of pressurized liquid at the machine. This back pressure is sufficiently high to prevent chemical from being injected through the Venturi-type injector, thereby enabling the operator to blast soils with the mechanical action of the high-pressure liquid.

Figure 4:
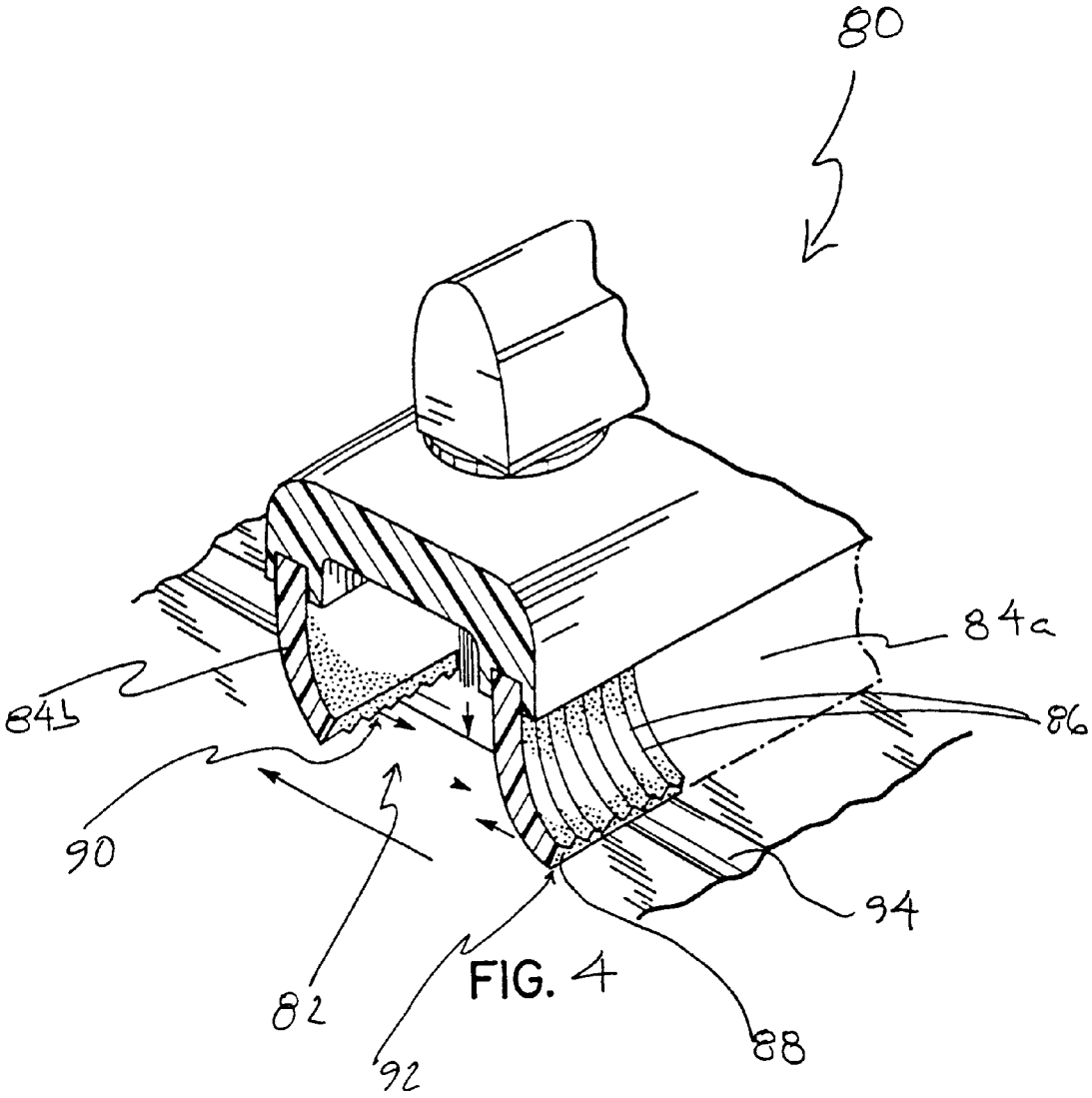

FIG. 4 shows a tool 80 quite similar to that of FIGS. 2 and 3. In further detail, the tool 80 is being pulled by the operator, back toward the operator. As may be seen, water is being blasted from the orifice of the high-pressure nozzle (not shown), into the interior space 80. One of the many advantages of the tool is the squeegees 84*a,b* having serrations which extend from the outer edge of the base surface 88 upward along the exterior surface, whereas the inner edge of the base surface 88 is generally smooth. As is evident from FIG. 4, when the tool 80 is moved in a forward or backward direction, the squeegees 84*a,b* bend slightly. This action enables air, water, and/or soil to enter into the interior space 82 through the space created between the serrations and the floor as at 90. On the other hand, the squeegee interior surfaces provide a smooth surface against the floor, as at 92, containing the water and dirt in the interior space 82 until it is taken up through the soil uptake opening. This same beneficial situation occurs when the tool 80 is pulled back in a rearward direction along a group line 94, with the roles of the front and back portions essentially being reversed.

At any point, an operator may turn the handle of the diverter switch to the closed position, thereby preventing liquid from flowing out of either of the nozzles. This feature allows an operator to prevent liquid from dripping out of the nozzles. It also is especially useful when vacuuming up dirty solution.

Figure 5:
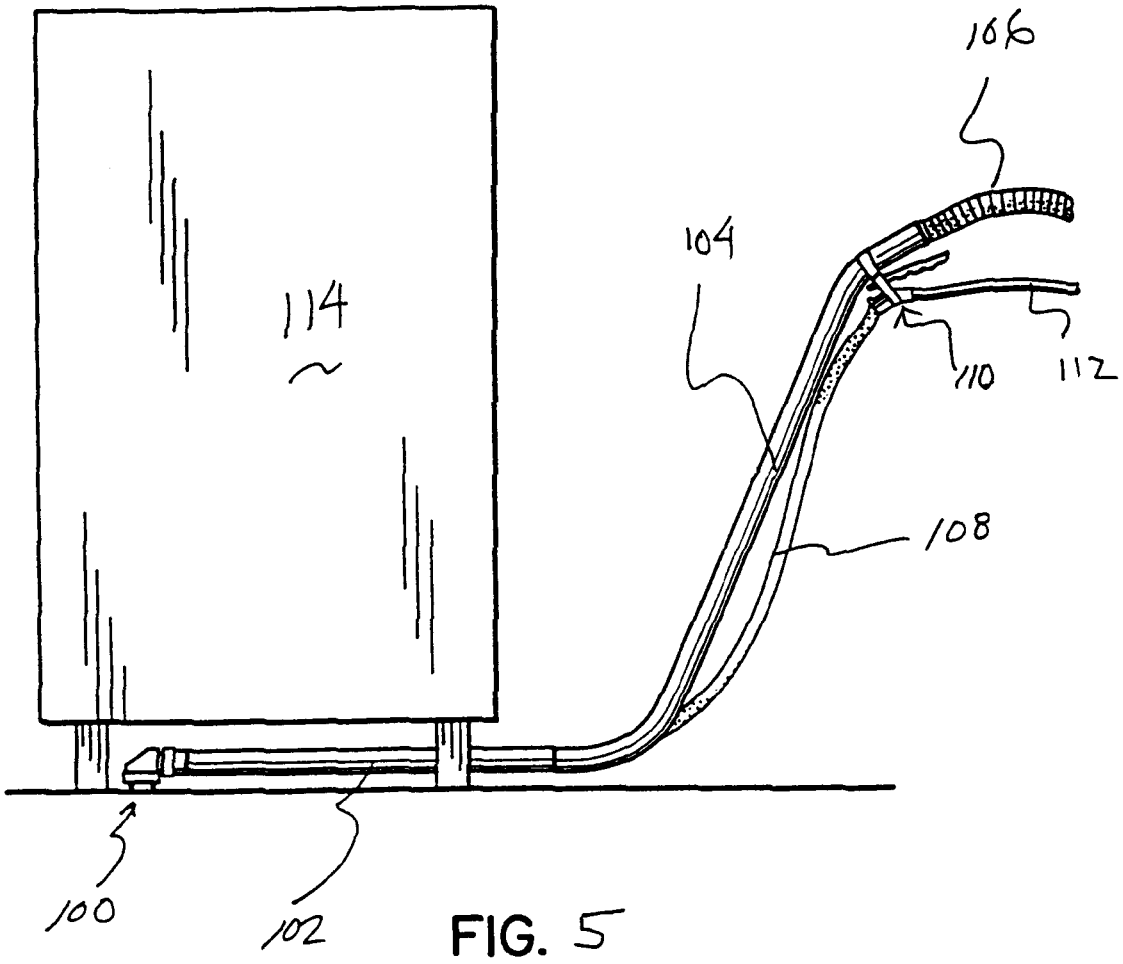
Figure 2:
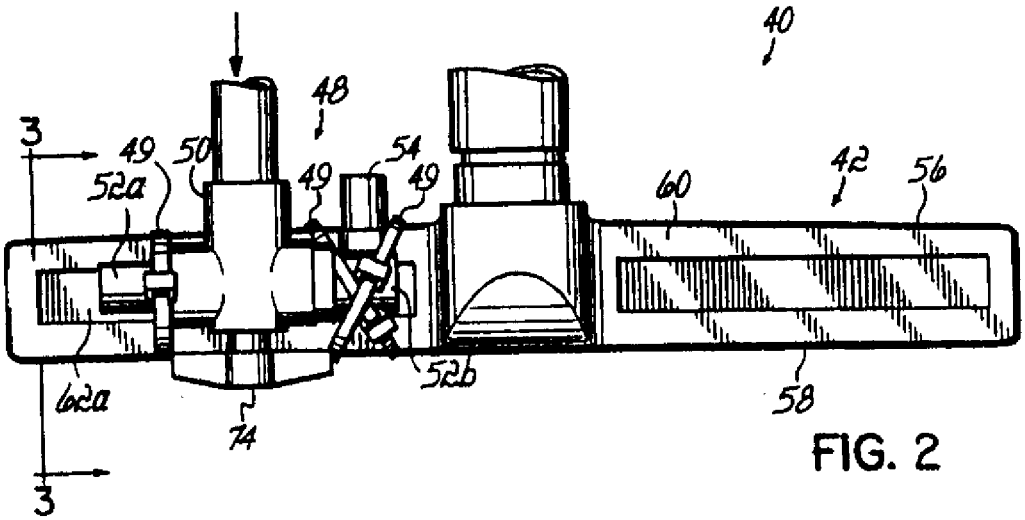
Figure 3:
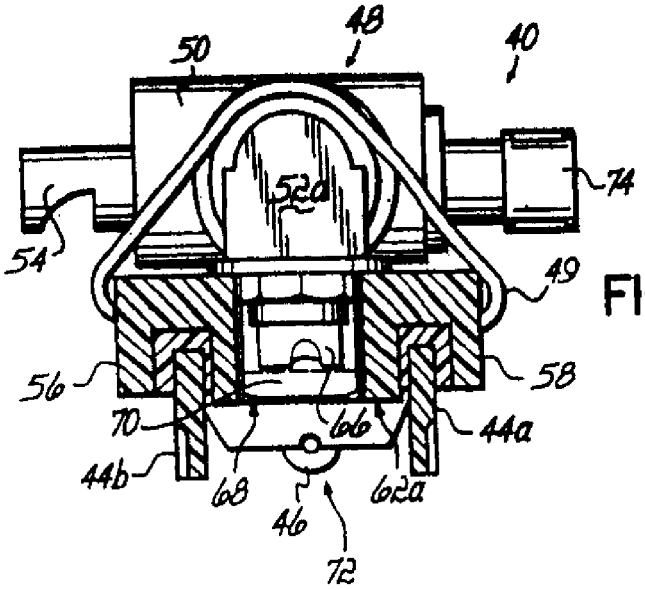
Figure 4:
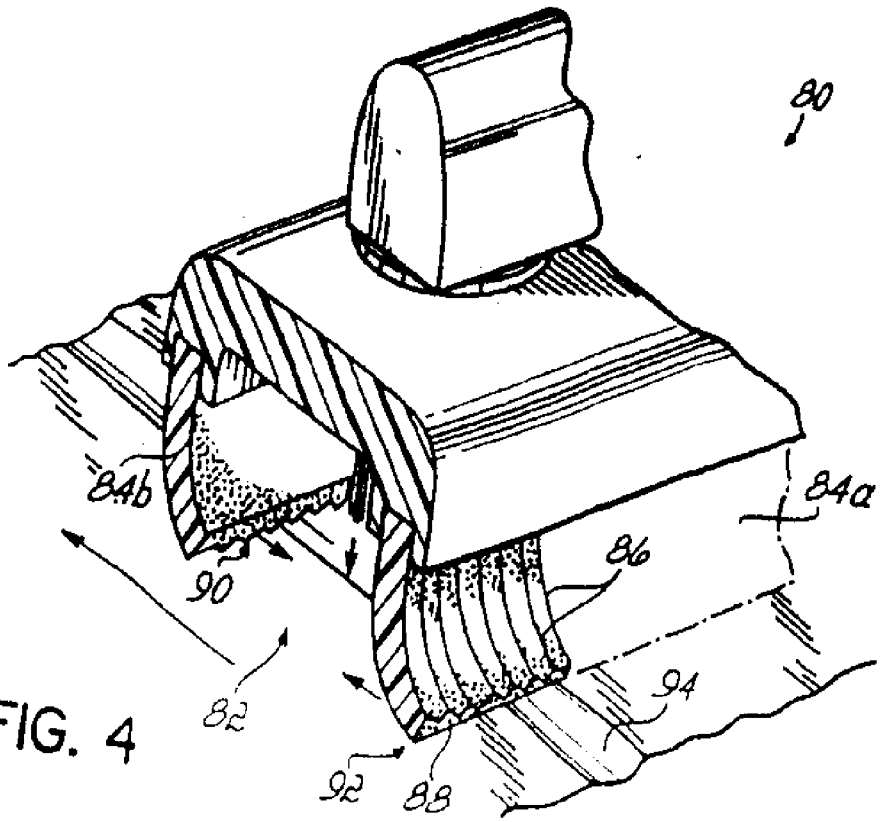
Figure 5:
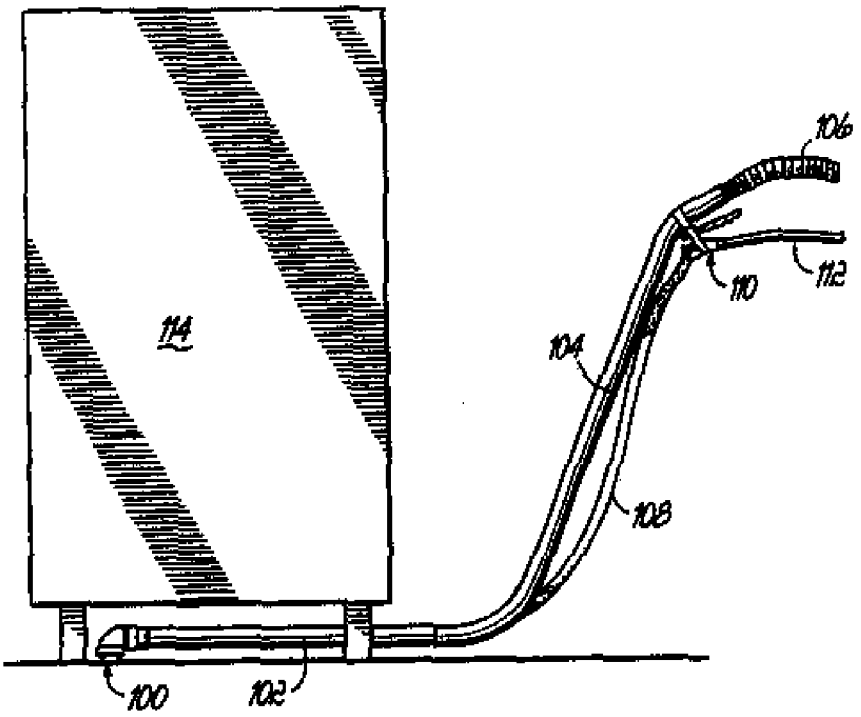

With reference to FIG. 5, the tool 100 is connected to a four-foot wand extension 102, wand 104, and vac hose 106, with the vac hose 106 being connected to a vacuum source (not shown). The tool 100 also is connected to pressure hose 108 which runs from the tool, along the extension, and along the wand, itself, where the hose connects with a conventional trigger valve assembly 110. The opposite end of the trigger valve assembly 110 is connected to pressure hose 112 leading to a source of pressurized liquid. The wand extension 102 enables an operator to use the tool 100 to clean under hard tour-each places, such as heavy shelving cabinets 114.

As appreciated by those of ordinary skill in the art, individual component parts may be obtained from any of a number of suitable sources. For example, if decided, the three way valve may be a brass valve such as Valve No. 3422590 from Speciality Manufacturing of St. Paul, Mich. A suitable part for use in forming the housing with squeegee blades is Part. No. 31.9 204-41 from Wessell Werk of Hillsborough, N.J. If desired, suitable 90° elbows may be obtained McMaster Card of Chicago, Ill. as Part. No. 5078 5K43. If desired, the high-pressure nozzle may be H ¼ W-1503 and the low-pressure nozzle may be nozzle ¼ K-15, available from Spraying Systems, Chicago, Ill. Suitable pressure hose, hose guards, ferrules, and hose bards are available from Cincinnati Hose, Cincinnati, Ohio, under Part Nos. GPH-4-BLK-473, HBR-4-1893-4, and 125HBL-4-4, respectively. If desired, the trigger valve may be Part No. V800/AC64 available from Production Metal Forming of Kiamath Falls, Oreg. In addition, if desired, suitable connecting components may be used in order to connect the trigger valve to a source of pressurized liquid. For example, if desired, a quick-disconnect plug may be securely fastened to a 45° elbow via a nipple fitting, with the other end of the 45° elbow being securely fastened to the inlet end of the trigger valve. On such quick-disconnect plug is the 7203 plug available from J. E. Adams of Cedar Rapids, Iowa. A suitable nipple connector is available from M. S. C. of Plainview, N.Y. as Part No. 48772180. A suitable 45° elbow is available from McMaster Card as Part No. 50785K82. If desired, a thread sealant may be used to facilitate the formation of water-tight seals. If desired, the vac wand may be wand No. 21AP5 from United Electric of Burlington, N. C., and the valve hanger may be Part No. AC31 available from Production Metal Forming.

The cleaning tool may be made in a series of convenient steps. For example, the multi-valve assembly is formed by threading a 90° elbow into each of the outlet ports of the three-way valve. The high-pressure, focused-spray nozzle is threaded into one elbow, and the low-pressure, fan-pattern nozzle is threaded into the other elbow. If desired, any suitable joint-sealing material may be used to facilitate the formation of water-tight seals between the various fittings.

In order for liquid from the hi-pressure nozzle to be able to access the interior space of the cleaning-tool housing, an opening may be drilled or otherwise formed in the upper wall of the housing, with the hole being positioned so that it is in registry with the outlet orifice of the hi-pressure nozzle.

The multi-nozzle assembly may be mounted to the housing in any suitable fashion. For example, if desired, a series of holes may be drilled in the sidewalls of the housing. These holes may receive conventional plastic fasteners or other ties which pass through the holes and which wrap around the multi-nozzle assembly, thereby securing the assembly to the housing. Prior to the mounting of the assembly to the housing, the indicator tape is adhesively secured to the upper surface of the housing on each side of the borehole. At this point, the segment of tubing may be slipped over the outlet end of the hi-pressure nozzle, and the multi-nozzle subassembly may be mounted to the housing.

If desired, the multi-functional cleaning tool may be provided in combination with a wand, pressure hose, and trigger valve. In this instance, pressure hose is cut to the appropriate length, a length which depends on the length of the particular wand, as well as whether or not a wand extension is to be used. A plastic hose guard may be slipped over each end of the pressure hose, with each end of the hose receiving a ferrule and a hose barb. A crimping tool may be used to securely fasten the ferrules to the ends of the pressure hose. At this point, if desired, one end of the hose may be threadingly secured to the inlet of the three way valve. And, as noted above, if desired, a suitable sealing material may be used to facilitate a water-tight seal. If a conventional trigger valve is used, the trigger valve may be assembled with other conventional fittings, for example, a 45° elbow, a nipple, and a quick disconnect plug. The free end of the pressure hose then may be threaded into the outlet end of the trigger valve assembly, again using a sealing material, if desired. The trigger valve assembly may be connected to the wand using a conventional hanger or other suitable connecting device. In addition, ties or other fasteners may be used to secure the length of pressure hose to the wand, along the length of the wand.

While the present invention has been illustrated by description of versions, and while the illustrative versions have been described in considerable detail, it is not the intention of the inventor to restrict or any way limit the scope of the appended claims to such detail. Additional advantages and modifications will readily appear to those skilled in the art upon reading this Detailed Description. Therefore, the invention, in its broader aspects, is not limited to these specific details, representative apparatus and methods, and illustrative examples shown and described. Accordingly, departures may be made from such details without departing from the spirit or scope of the inventor's general inventive concept.

What is claimed is:

1. A multi-functional floor-cleaning tool for use with a pressurized-liquid source and a vacuum source, comprising:

a housing having a front wall, a back wall, a top wall connecting the front and back walls, an interior surface, a liquid-delivery opening, and a soil-uptake opening, the soil-uptake opening being connectable to a vacuum source;

a first squeegee blade depending from the front wall;

a second squeegee blade depending from the back wall;

an interior space defined by the interior surface, first squeegee blade, and second squeegee blade;

a diverter valve having at least an inlet, a first outlet, a second outlet, and a diverter, the diverter capable of selectively directing the flow of a liquid from the inlet to either the first outlet or the second outlet, the diverter valve being connectable to a pressurized-liquid source;

a high-pressure nozzle connected to the first outlet of the diverter valve, the high-pressure nozzle constructed and arranged to deliver a liquid into the interior space via the liquid-delivery opening; and a low-pressure nozzle connected to the second outlet of the diverter valve, the low-pressure nozzle constructed and arranged to deliver a liquid exterior to the interior space.

2. The multi-functional floor-cleaning tool of claim 1 wherein the high-pressure nozzle has an oulet orifice, and the high-pressure nozzle is constructed to deliver a focused, pinpoint jet of liquid from the outlet orifice.

3. The multi-functional floor-deaning tool of claim 1 wherein the low-pressure nozzle is constructed and arranged to deliver a liquid downward from behind the back wall of the housing.

4. The multi-functional floor-cleaning tool of claim 3 wherein the low-pressure nozzle is a fan nozzle, whereby a liquid exiting the low-pressure nozzle has a fan-shaped patterm.

5. The multi-functional floor-cleaning tool of claim 1 wherein the low-pressure nozzle is a fan nozzle, whereby a liquid exiting the low-pressure nozzle has a fan-shaped pattern.

6. The multi-functional floor-cleaning tool of claim 5 wherein the low-pressure nozzle has an outlet orifice and an arcuate deflector plate spaced from the outlet orifice.

7. The multi-functional floor-cleaning tool of claim 1 wherein the diverter valve is a three-way valve, the diverter capable of selectively directing the flow of a liquid from the inlet to either the first outlet or the second outlet.

8. The multi-functional floor-cleaning tool of claim 7 wherein the diverter valve includes a handle operatively connected to the diverter, thereby enabling an operator to selectively direct the flow of a liquid from the inlet to either the first outlet or the second outlet.

9. The multi-functional floor-cleaning tool of claim 8 wherein the diverter of the diverter valve may be oriented in a plurality of positions so as to provide larger and smaller flow paths to the first outlet, larger and smaller flow paths to the second outlet, and a completely blocked flow path to both the first and second outlets.

10. The multi-functional floor-cleaning tool of claim 1 wherein each of the first and second squeegee blades has an exterior surface and a base surface, the exterior surface including serrations which extend from the base surface upward toward the housing.

11. The multi-functional floor-cleaning tool of claim 1 wherein the housing further includes at least two wheels or glides.

* * * * *

UNITED STATES PATENT AND TRADEMARK OFFICE

CERTIFICATE OF CORRECTION

PATENT NO. : 6,647,585 B1
DATED : November 18, 2003
INVENTOR(S) : Robert S. Robinson It is certified that error appears in the above-identified patent and that said Letters Patent is hereby corrected as shown below:

The title page, showing an illustrative figure, should be deleted and substitute therefor the attached page.

Delete Drawing Sheets 1-5 and substitute therefor the Drawing Sheets consisting of FIG 1-5 as shown on attached page.

Column 1,
Line 5, "This latent document" should read -- This patent document --.
Line 19, "remote location Such" should read -- remote location. Such --.

Column 2,
Line 4, "the dirty restrooms complaint is" should read -- the dirty restroom complaint is --.
Line 10, "when comes to dealing with" should read -- when it comes to dealing with --.
Line 11, "with many restrooms" should read -- with many restroom --.
Line 12, "having group" should read -- having grout --.
Line 13, the group lines tend" should read -- the grout lines tend --.
Line 26, "washer were use to" should read -- washer were used to --.
Line 41, "do not have there" should read -- do not have their --.

Column 4,
Line 22, insert the following inadvertently deleted text:

Fig. 1 is a perspective view of a version of the multi-functional floor-cleaning tool of the present invention;

Fig. 2 is a top view of another version of the multi-functional floor-cleaning tool of the present invention;

Fig. 3 is a partial cross-sectional side view of the multi-functional floor-cleaning tool of Fig. 2, taken along line 3-3;

Fig. 4 is a partial cross-sectional elevated view of a version of the multi-functional floor-cleaning tool substantially similar to the version shown in Fig. 3; and Fig. 5 is a side view of a further version of the multi-functional floor-cleaning tool of the present invention.

Line 51, "wet alarge surface area" should read -- wet a large surface area --.

Column 5,
Line 25, "90 degree elbow D leading to" should read -- 90 degree elbow 52a leading to --.
Line 26, "high-pressure valve 66" should read -- high-pressure valve 66 --.
Line 31, "from group lines" should read -- from grout lines --.
Line 44, "the interior space 80" should read -- the interior space 82 --.
Line 58, "along a group line 94," should read -- along a grout line 94, --.

UNITED STATES PATENT AND TRADEMARK OFFICE

CERTIFICATE OF CORRECTION

PATENT NO. : 6,647,585 B1
DATED : November 18, 2003
INVENTOR(S) : Robert S. Robinson It is certified that error appears in the above-identified patent and that said Letters Patent is hereby corrected as shown below:

Column 6,
Line 9, "under hard tour-each places, such as" should read -- under hard-to-reach places, such as --.
Line 13, "if decided, the" should read -- if desired, the --.
Line 19, "obtained McMaster" should read -- obtained from McMaster --.
Line 19, "McMaster Card of Chicago" should read -- McMaster Carr of Chicago --.
Line 21, "W-1503 and" should read -- VV-1503 and --.
Line 28, "Kiamath Falls, Oreg." should read -- Klamath Falls, Oregon --.
Line 38, "from McMaster Card as" should read -- from McMaster Carr as --.
Line 52, "hi-pressure nozzle" should read -- high-pressure nozzle --.
Line 56, "hi-pressure" should read -- high-pressure --.

Column 7,
Line 1, "the hi-pressure nozzle, and" should read -- the high-pressure nozzle, and --.

Column 8,
Line 12, "has an oulet orifice, and" should read -- has an outlet orifice, and --.
Line 15, "floor-deaning tool of" should read -- floor-cleaning tool of --.
Line 22, "patterm" should read -- pattern --.

Signed and Sealed this

Second Day of August, 2005

JON W. DUDAS
*Director of the United States Patent and Trademark Office*

(12) United States Patent
Robinson

(10) Patent No.: US 6,647,585 B1
(45) Date of Patent: Nov. 18, 2003

(54) MULTI-FUNCTIONAL FLOOR-CLEANING TOOL

(75) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 0 days.

(21) Appl. No.: 10/011,144

(22) Filed: Nov. 6, 2001

Related U.S. Application Data

(60) Provisional application No. 60/246,184, filed on Nov. 6, 2000.

(51) Int. Cl.[7] ..... A47L 9/02
(52) U.S. Cl. ..... 15/322; 15/401; 239/754
(58) Field of Search ..... 15/321, 322, 401; 239/754

(56) References Cited

U.S. PATENT DOCUMENTS

| | | | | | |
|---|---|---|---|---|---|
| 2,243,935 | A | | 6/1941 | Williamson | |
| 3,802,628 | A | | 4/1974 | Goss et al. | |
| 3,913,837 | A | | 10/1975 | Grant | |
| 4,218,900 | A | | 8/1980 | Caplan et al. | 15/322 |
| 4,270,238 | A | | 6/1981 | Shallenberg et al. | 15/321 |
| 4,461,052 | A | | 7/1984 | Mostul | |
| 4,596,061 | A | | 6/1986 | Henning | 15/322 |
| 4,654,925 | A | | 4/1987 | Grave | 15/322 |
| 4,879,784 | A | | 11/1989 | Shero | 15/322 |
| 5,212,848 | A | | 5/1993 | Geyer | 15/401 |
| 5,377,382 | A | * | 1/1995 | Bores et al. | 15/320 |
| 5,455,982 | A | * | 10/1995 | Armstrong et al. | 15/320 |
| 5,584,094 | A | | 12/1996 | Gurstein | 15/321 |
| 5,706,548 | A | | 1/1998 | Schabacker | 15/322 |
| 5,813,087 | A | | 9/1998 | Huffman | 15/321 |
| 5,819,366 | A | | 10/1998 | Edin | 15/322 |
| 5,898,970 | A | | 5/1999 | Stratton | 15/321 |
| 5,991,968 | A | | 11/1999 | Moll et al. | 15/322 |
| 6,052,861 | A | | 4/2000 | Keller | 15/321 |
| 6,055,699 | A | | 5/2000 | Cho | 15/321 |
| 6,206,980 | B1 | | 3/2001 | Robinson | 134/21 |
| 6,247,202 | B1 | * | 6/2001 | Lesco et al. | 15/320 |
| 6,453,506 | B1 | * | 9/2002 | Sumner | 15/322 |

* cited by examiner

*Primary Examiner*—Theresa T. Snider
(74) *Attorney, Agent, or Firm*—Wood, Herron & Evans LLP

(57) ABSTRACT

In one aspect of the invention, the tool includes: a housing having a front wall, a back wall, a top wall connecting the front and back walls, an interior surface, a liquid-delivery opening, and a soil-uptake opening, the soil-uptake opening being connectable to a vacuum source; a first squeegee blade depending from the front wall; a second squeegee blade depending from the back wall; an interior space defined by the interior surface, first squeegee blade, and second squeegee blade; a diverter valve connected to the housing, the diverter valve having at least an inlet, a first outlet, a second outlet, and a diverter, the diverter capable of selectively directing the flow of a pressurized liquid from the inlet to either the first outlet or the second outlet, the diverter valve being connectable to a pressurized-liquid source; a high-pressure nozzle connected to the first outlet of the diverter valve, the high-pressure nozzle constructed and arranged to deliver a liquid into the interior space via the liquid-delivery opening; and a low-pressure nozzle connected to the second outlet of the diverter valve, the low-pressure nozzle constructed and arranged to deliver a liquid exterior to the interior space.

11 Claims, 5 Drawing Sheets

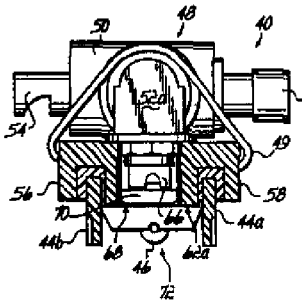

FIG. 3

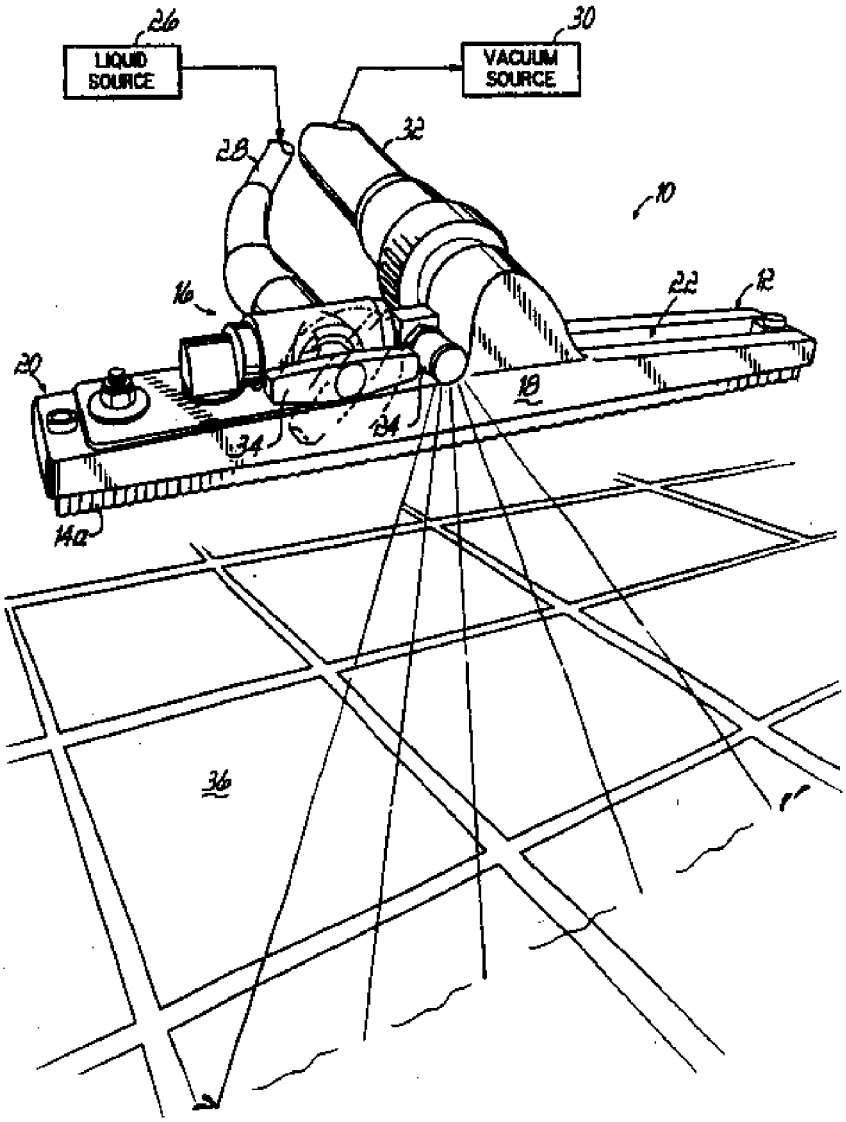
26
LIQUID SOURCE
30
VACUUM SOURCE
28
32
10
16
22
12
20
18
34
34
14a
36